US011637397B2

(12) United States Patent
Lindkamp et al.

(10) Patent No.: US 11,637,397 B2
(45) Date of Patent: Apr. 25, 2023

(54) PLUG CONNECTOR HAVING SHOCK HAZARD PROTECTION

(71) Applicant: HARTING ELECTRONICS GMBH, Espelkamp (DE)

(72) Inventors: Marc Lindkamp, Luebbecke (DE); Guenter Pape, Enger (DE)

(73) Assignee: HARTING ELECTRONICS GMBH

( * ) Notice: Subject to any disclaimer, the term of this patent is extended or adjusted under 35 U.S.C. 154(b) by 75 days.

(21) Appl. No.: 16/968,551

(22) PCT Filed: Apr. 10, 2019

(86) PCT No.: PCT/DE2019/100332
§ 371 (c)(1),
(2) Date: Aug. 7, 2020

(87) PCT Pub. No.: WO2019/201387
PCT Pub. Date: Oct. 24, 2019

(65) Prior Publication Data

US 2021/0057847 A1 Feb. 25, 2021

(30) Foreign Application Priority Data

Apr. 20, 2018 (DE) ..... 10 2018 109 557.0

(51) Int. Cl.
*H01R 13/627* (2006.01)
*H01R 13/533* (2006.01)
*H01R 13/447* (2006.01)

(52) U.S. Cl.
CPC ..... *H01R 13/533* (2013.01); *H01R 13/447* (2013.01); *H01R 13/6272* (2013.01); *H01R 2201/26* (2013.01)

(58) Field of Classification Search
CPC ..... H01R 13/44; H01R 13/447; H01R 13/5208; H01R 13/533; H01R 13/6272;
(Continued)

(56) References Cited

U.S. PATENT DOCUMENTS 4,607,903 A * 8/1986 Hoshino ..... H01R 13/6271 439/372
4,674,814 A * 6/1987 Hoshino ..... H01R 13/62 439/372
(Continued)

FOREIGN PATENT DOCUMENTS

CN 101740929 6/2010 ..... H01R 13/44
CN 107851930 3/2018 ..... H01R 13/58
(Continued)

OTHER PUBLICATIONS

German Office Action issued in German Patent Appln. Serial No. 10 2018 109 557.0, dated Mar. 13, 2019, with machine English translation, 19 pages.
(Continued)

*Primary Examiner* — Vanessa Girardi
(74) *Attorney, Agent, or Firm* — Hayes Soloway P.C.

(57) ABSTRACT

A plug-side first electrical plug connector has at least two flat electrical contact elements arranged in parallel extending in a housing of the connector in the insertion direction of the connector for accommodating socket-side second plug connector in the direction of an opening of the housing. A plastic tip is formed on one end of a contact region of the contact elements, and at least one dome-like shock hazard protection element is provided in the housing, extending in the insertion direction adjacent to the contact elements and protrudes beyond the contact region of the contact elements. The plug connector is suitable for a motor vehicle inverter to supply power to an auxiliary unit of the motor vehicle, and provides shock hazard protection of the contact elements for a human finger and/or reliable operating security is provided.

17 Claims, 4 Drawing Sheets

(58) Field of Classification Search
CPC ..... H01R 13/6273; H01R 13/629; H01R 13/639; H01R 13/74; H01R 13/6271; H01R 13/6456; H01R 13/5213
See application file for complete search history.

(56) References Cited

U.S. PATENT DOCUMENTS 4,884,978 A * 12/1989 Inaba ..... H01R 13/6272 439/372
5,344,330 A * 9/1994 Hoffman ..... B60L 53/16 439/138
5,443,389 A * 8/1995 Hughes ..... B60D 1/64 439/651
5,454,729 A 10/1995 Wen-Te ..... 439/357
5,571,023 A 11/1996 Anthony ..... 439/142
5,626,479 A * 5/1997 Hughes ..... H01R 31/065 439/651
7,824,210 B2 11/2010 Oka et al. ..... 439/372
10,218,112 B2 2/2019 Luettermann et al. ..... H01R 13/582
10,320,123 B1 * 6/2019 Sundarakrishnamachari ..... H01R 13/64
2004/0147169 A1 * 7/2004 Allison ..... H01R 13/44 439/677
2007/0093115 A1 4/2007 Gremillion et al.
2009/0130869 A1 * 5/2009 Freimuth ..... H01R 13/516 439/83
2010/0120284 A1 * 5/2010 Oka ..... H01R 13/44 439/372
2011/0053404 A1 3/2011 Tsuruta et al. ..... 439/345
2011/0250769 A1 10/2011 Wang et al. ..... 439/108
2015/0180181 A1 * 6/2015 Loncar ..... H01R 13/6275 439/345
2015/0295339 A1 * 10/2015 Bartholomew ..... H01R 25/006 439/131
2016/0064849 A1 3/2016 Eckel ..... H01R 13/44
2017/0025787 A1 1/2017 Choi et al. ..... H01R 13/53

FOREIGN PATENT DOCUMENTS

DE WO 2009/099748 8/2009 ..... H01R 13/44
DE 10 2010 035 943 3/2012 ..... H01R 13/44
DE 10 2012 105 839 2/2014 ..... H01R 13/44
DE 20 2015 009 490 1/2018 ..... H01R 13/44
WO WO 2011/053749 5/2011 ..... H01R 13/447
WO WO 2014/115045 7/2014 ..... F21V 25/04

OTHER PUBLICATIONS

International Preliminary Report on Patentability issued in PCT/DE2019/100332, dated Oct. 20, 2020, 8 pages.
International Search Report and Written Opinion issued in PCT/DE2019/100332, dated Jun. 11, 2019, with English translation, 20 pages.
Chinese Search Report issued in Chinese Appln, Serial No. 201980027014.3, dated Jan. 13, 2022, with English translation 5 pages.

* cited by examiner

PLUG CONNECTOR HAVING SHOCK HAZARD PROTECTION

BACKGROUND OF THE INVENTION

The invention relates to a plug connector having shock hazard protection and/or reliable operating safety, in particular of an auxiliary assembly inverter in particular of a power supply system of a motor vehicle.

Inverters with plug connectors are required for supplying power to auxiliary assemblies in motor vehicles for example for operating an air-conditioning system and/or a steering assistance pump, etc. Since the output voltage which is applied to a plug connector can be several hundred volts here and an environment which is sensitive to electrical connections or contact connections and can be damp and dusty prevails in vehicles, it is necessary in particular to also equip plug connectors of this kind with shock hazard protection for protecting an operator.

Owing to the high currents and/or voltages, stringent safety requirements are in place in this case. For example, European standards, such as IEC/EN 61984 for example, prescribe that contact elements of plug connectors of this kind have to be protected for protection against contact by a human finger.

A so-called test finger is provided for a corresponding test, which test finger is intended to simulate a human fingertip and is pressed against sections or openings of the plug element, via which sections or openings the contact elements are accessible, with a prescribed test force, without said test finger being able to come into contact with current-carrying sections of the contact elements in the process.

PRIOR ART

DE 10 2010 035 943 A1 proposes an electrical pin contact element for a plug connector in motor vehicle engineering having a shock hazard protection body which extends along two opposite sides of the pin contact element. In this case, the above specification is concerned in detail with the mathematical/geometric relationships between arrangement and design of the pin contact element and shock hazard protection body and a standardized test finger for simulating contact with the pin contact element by a human finger.

In this case, an electrically contactable upper end of the pin contact element of DE 10 2010 035 943 A1 is furthermore disadvantageously exposed between the shock hazard protection bodies for direct contact in the insertion direction of the plug connector.

The German Patent and Trademark Office has searched the following prior art in the priority application of the present application:

DE 10 2012 105 839 A1, DE 20 2015 009 490 U1, US 2017/0025797 A1 and U.S. Pat. No. 5,571,023 A.

OBJECT OF THE INVENTION

The object of the invention is that of specifying a plug connector having shock hazard protection and/or reliable operating safety in particular of an inverter of a motor vehicle.

Advantageous embodiments of the invention are specified in the following description which is accompanied by schematic drawings.

SUMMARY OF THE INVENTION

The invention relates, in particular, to a plug-side electrical plug connector having at least two flat electrical contact elements which are arranged parallel next to one another and extend in a housing of the plug connector in the insertion direction of the plug connector for connection to a socket-side plug connector which corresponds to said plug-side electrical plug connector in the direction of an opening of the housing.

A plastic tip is formed at one end of a contact region of the contact elements, and also at least one dome-like shock hazard protection body is provided in the housing, which dome-like shock hazard protection body extends adjacent to the contact elements in the insertion direction and in this case has a predetermined height which corresponds at least approximately to the height of the contact region of the contact elements.

Here, the shock hazard protection body can particularly advantageously have a height such that the shock hazard protection body projects beyond the contact region of the contact elements by at least a predetermined amount.

In this case, the shock hazard protection body which is adjacent to the contact elements can be arranged, in particular, at a predetermined distance spaced apart from the contact elements.

In this case, the plug connector is advantageously designed in such a way that protection of its contact elements against contact by a human finger and/or reliable operating safety of the plug connector is provided. For this purpose, the shock hazard protection body can project beyond at least the contact region of the contact elements in the insertion direction as stated above in a suitable manner by a predetermined amount, which is selected in such a way that contact with the contact region in particular by a test finger according to IEC/EN 61984 both in the insertion direction and also at an angle in relation to the insertion direction is precluded. It is also clear that the abovementioned predetermined distance of the shock hazard protection body from the contact elements is also suitably selected for this purpose.

An abovementioned test finger of this kind is suitable for simulating contact by a human finger, whereby contact by a human finger can therefore likewise be precluded.

Since the end of the contact region of the contact elements is provided with a plastic tip, which insulates the end of the contact elements, in addition to the shock hazard protection body, largely any contact with the contact region in the insertion direction of the plug connector is also advantageously precluded in this case.

Accordingly, a plug connector which has particularly reliable shock hazard protection and/or particularly reliable operating safety is provided by means of the abovementioned combination of a shock hazard protection body which is adjacent to the contact elements with the plastic tip of the contact elements.

The plastic tip is provided at the abovementioned end of the contact region of the contact elements, wherein the contact elements can have a suitable holding geometry for holding the plastic tip in a stable and stationary manner.

In this case, the holding geometry can be designed as a stump-like protrusion with a suitable contour, and/or have a suitable hole. In this case, the plastic tip can be designed as a cap which corresponds to the holding geometry in an interlocking manner and latches with the holding geometry in a stable and stationary manner, wherein the plastic tip can also be adhesively bonded to the holding geometry.

To this end, the plastic tip can particularly advantageously be injection-molded onto the projecting end of the contact region of the contact elements, whereby the plastic tip is seated on a contact element in a particularly stable and stationary manner.

The shock hazard protection body can, like the housing, be provided from a suitable insulating plastic, wherein the shock hazard protection body can be integrally formed with the housing in a suitable manner.

An integral design of the housing and the shock hazard protection body renders possible simple and cost-effective production and also desirable stability of the shock hazard protection body in the housing.

An advantageous locking mechanism for releasably fixing the plug connectors which are connected to one another can also be provided on the socket-side plug connector and/or plug-side plug connector. For this purpose, the socket-side plug connector can have at least one locking hook in a suitable manner, which at least one locking hook interacts with a latching lug which corresponds to said at least one locking hook and is provided on the housing or on a wall bushing of the housing for mounting the plug connector for its intended use.

This largely precludes unintended release/disconnection of a connection between the two plug connectors, as a result of which shock hazard protection in the run-up to possible contact and therefore in particular desirable reliable operating safety of the plug connectors is provided in addition to the abovementioned shock hazard protection.

Furthermore, it is advantageous to provide a further shock hazard protection on the plug connector, which further shock hazard protection prevents any contact with the contact elements from outside the housing in a stable and reliable manner. For this purpose, a pivotable protective flap, which can advantageously be equipped with a suitable releasable locking mechanism, can be provided in a suitable manner on the housing or on a wall bushing for the housing for mounting the plug connector for its intended use.

An abovementioned protective flap of this kind can have at least one locking hook which is suitable for this purpose, which locking hook likewise corresponds to and interacts with the above-described latching lug. Accordingly, the latching lug has an advantageous dual function as a constituent part of a locking mechanism for the socket-side plug connector and also for the protective flap on the plug-side plug connector.

Here, a locking hook of the protective flap can furthermore be designed in a manner corresponding to a locking hook and/or to the housing of the socket-side plug connector in such a way that, when the plug-side plug connector and the socket-side plug connector are connected, the abovementioned locking hooks can be latched to one another and/or the locking hook of the protective flap can be latched to the housing of the socket-side plug connector.

Advantageous secondary locking for the socket-side plug connector on the plug-side plug connector is provided in this way. An abovementioned locking hook of the protective flap accordingly has an advantageous dual function, like the abovementioned latching lug.

This measure also makes a contribution to unintended release/disconnection of a connection between the two plug connectors being able to be largely precluded, as a result of which in particular desirable reliable operating safety is already provided in the run-up to any possible contact with the contact elements of the plug connector.

It is advantageous to form at least one recess in the socket-side plug connector in a manner corresponding to a respective above-described shock hazard protection body in such a way that guidance for connecting and/or disconnecting the plug-side plug connector and the socket-side plug connector is provided. In this way, incorrect contact-connection of the contact elements of the plug-side plug connector to appropriately corresponding contact elements of the socket-side plug connector is largely precluded in the event of connection and/or disconnection.

An above-described shock hazard protection body accordingly likewise has an advantageous dual function. Contact with the contact region of the contact elements is reliably prevented by means of the shock hazard protection body, as described above, firstly in combination with the abovementioned plastic tip. In addition, safe guidance for connecting/disconnecting the plug-side plug connector and the socket-side plug connector is provided by means of the shock hazard protection body.

Here, a stop for the socket-side plug connector, which stop, like the above-described guidance, can largely preclude incorrect operator control during connection/disconnection of the two plug connectors on the part of an operator, can also be provided by means of a shock hazard protection body of this kind in interaction with a suitable, corresponding recess of the socket-side plug connector.

A plug-side plug connector which is equipped with an abovementioned shock hazard protection can furthermore have at least one first shock hazard protection body which, as described above, can project beyond the contact region of its contact elements at least by a first predetermined amount, and also have at least one second shock hazard protection body having a height which corresponds at least approximately to the height of the contact region of the contact elements.

It is advantageous for the second shock hazard protection body to have a height here such that it projects beyond at least the contact region of the contact elements by a second predetermined amount. In this case, the second shock hazard protection body can be arranged at a predetermined suitable distance, in particular in a manner spaced apart from and adjacent to the contact elements, like the first shock hazard protection body.

Here, the abovementioned first and second shock hazard protection bodies can be suitably designed in a manner corresponding to the first and, respectively, second recess of the housing of the socket-side plug connector in such a way that above-described advantageous guidance for connecting and/or disconnecting the first plug connector and the second plug connector is provided by means of the first shock hazard protection body and the second shock hazard protection body in interaction with the abovementioned first recess and, respectively, the above-mentioned second recess. These measures also make a contribution to shock hazard protection and/or to improved reliable operating safety.

An abovementioned plug connector having shock hazard protection and/or reliable operating safety can be designed in accordance with its intended use. For example, a corresponding plug connector with a large number of contact elements which are arranged parallel next to one another in a row can have a corresponding large number of first shock hazard protection bodies and/or second shock hazard protection bodies.

An above-described plug connector which has shock hazard protection and/or reliable operating safety is suitable, in particular, for an inverter of a motor vehicle for supplying power to an auxiliary assembly of the motor vehicle. In particular, the contact elements of a plug connector having the above-described features are reliably protected against unintentional contact, in particular on the part of an operator, specifically also in a correspondingly sensitive environment which can be dusty and damp and in which vibrations can occur.

When a plug-side plug connector is mentioned here above and in the entire context of the application, the intended meaning is a male plug connector. When a socket-side plug connector is mentioned here above and in the entire context of the application, the intended meaning is a female plug connector which corresponds to an abovementioned male plug connector.

BRIEF DESCRIPTION OF THE DRAWINGS

Exemplary embodiments of the invention are illustrated in the drawings and will be explained in more detail below. In the drawings.

The figures contain partially simplified, schematic illustrations. In some instances, identical reference signs are used for similar, but possibly not identical, elements. Different views of the same elements could be shown to different scales.

DETAILED DESCRIPTION OF THE INVENTION

Figure 1A:
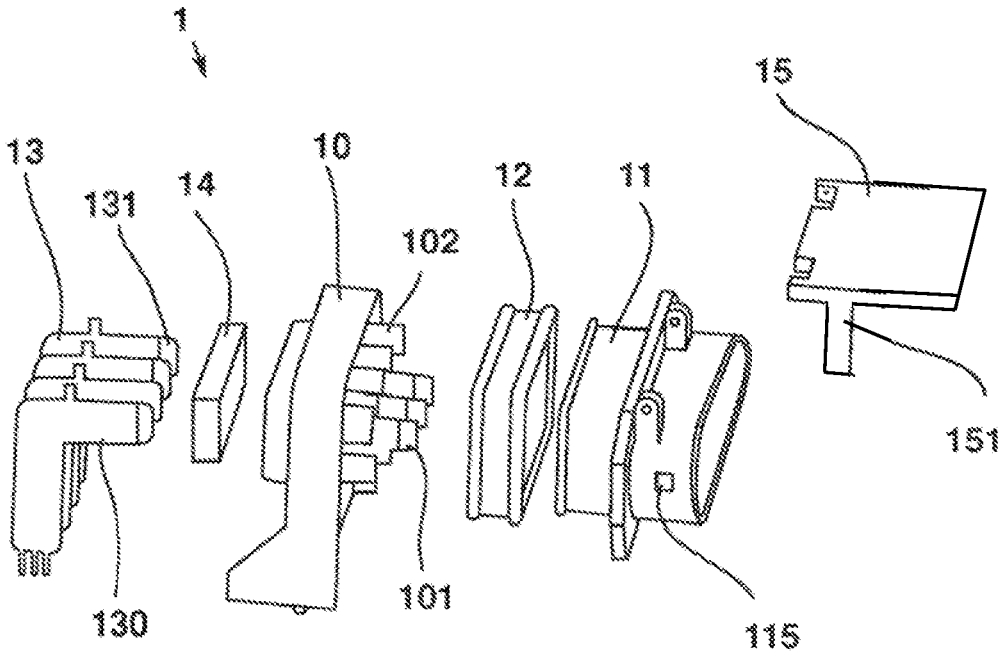
FIG. 1*a* shows a perspective exploded illustration of a plug connector having shock hazard protection according to one embodiment of the invention.
Figure 1B:
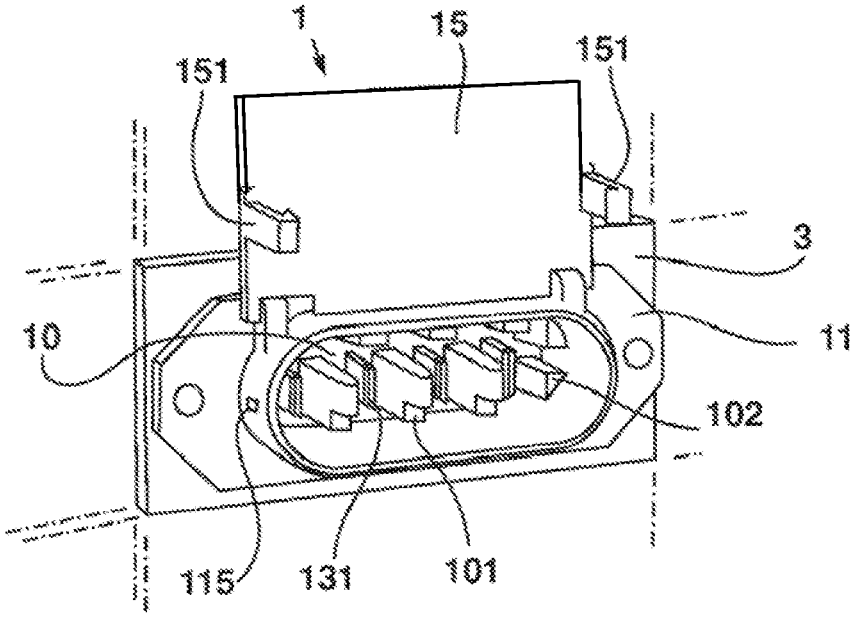
FIG. 1*b* shows the plug connector of FIG. 1*b* on a wall of a housing.

FIG. 1*a* shows a perspective exploded illustration of a plug-side plug connector 1 which has shock hazard protection according to one embodiment of the invention, and FIG. 1*b* shows the plug connector 1 of FIG. 1*a* for its intended use mounted on a wall 3 of a housing of an apparatus which can be, in particular, an inverter of an on-board electrical system of a motor vehicle.

The plug connector 1 comprises a housing 10 for accommodating, here by way of example, four contact elements 13 which are arranged parallel in relation to one another. The contact elements 13 which are of flat, substantially L-shaped design each have a contact region 130 which is provided for contact-connection with the contact region 230 by contact elements 23, which correspond to said contact elements 13, of a socket-side plug connector 2 which is described below with reference to FIGS. 2*a* and 2*b*.

The contact elements 13 extend by way of their contact regions 130 in the interior of the housing 10, and are accessible for contact to be made with them via an opening of the housing 10. In this case, the contacts 13 are fixed in a stationary manner in the interior of the housing 10 of the plug connector 1 by means of a potting compound 14, wherein the region thereof which protrudes on the other side of the potting compound 14 and of the housing 10 is likewise electrically contacted as intended and can be connected, for example, to contacts of a printed circuit board.

The contact elements 13 are held in a stationary manner in the housing 10 by means of the potting compound 14, and the housing 10 of the plug connector 1 is advantageously longitudinally watertight in the unplugged state. It is clear that the contact elements 13 can also be positioned in the housing 10 in another suitable manner. For example, a suitable watertight seat of the contact elements 13 can also be injected into the housing 10.

A wall bushing 11 for the housing 10 is provided for mounting on a wall 3 of a corresponding apparatus, by means of which wall bushing the housing 10 is fixed to the wall 3. A seal 12 is provided for the housing 10 and its wall bushing 11 for protecting the interior of the apparatus.

First shock hazard protection bodies 101, have dome-like ends 105 which project beyond the contact region 130 of the contact elements 13 advantageously by a predetermined amount in the insertion direction in this embodiment of the invention, are provided adjacent to the contact elements 13 in the housing 10. In this case, the contact elements 13 are arranged alternately with the shock hazard protection bodies 101 consecutively parallel in a row in the interior of the housing 10 and are each spaced apart from the contact elements 13 at a predetermined distance.

A plastic tip 131 is provided at the end of the contact region 130 of the contact elements 13. The plastic tip 131 of a contact element 13 interacts with the adjacent shock hazard protection bodies 101 of said contact element and protects the contact regions 130 of the contact elements 13 from contact in particular in the insertion direction of the plug connector 1.

Figure 4A:
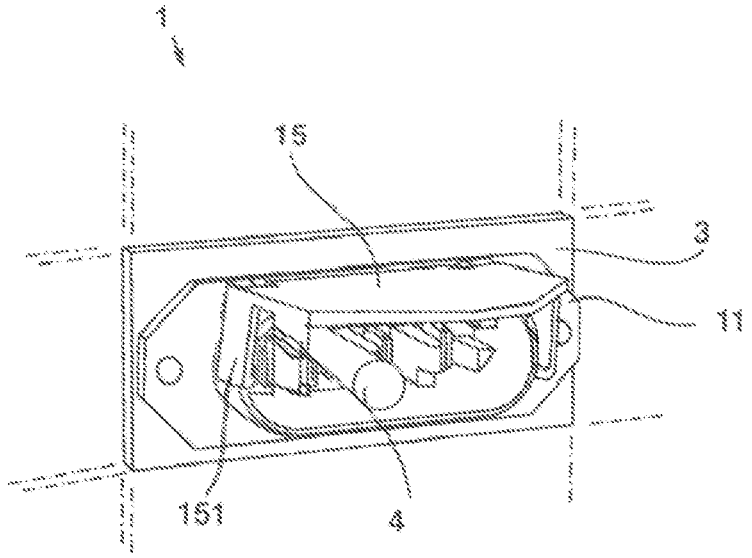
FIG. 4*a* shows a perspective illustration of the plug connector of FIGS. 1*a* and *b* on a wall of a housing together with a test finger.
Figure 4B:
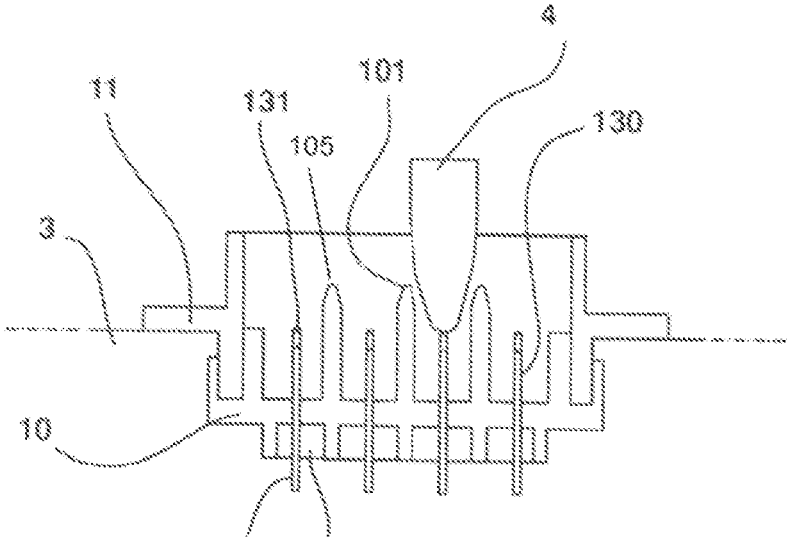
FIG. 4*b* shows a longitudinal section through the plug connector and the test finger of FIG. 4*a*.

In this context, reference is made here to the following description with reference to FIGS. 4*a* and 4*b*. A plug connector 1 according to an embodiment of the invention is provided with the abovementioned contact elements 13 which are designed and arranged in this way and the abovementioned shock hazard protection bodies 101.

Furthermore, the housing 10 comprises further shock hazard protection bodies 102 which are adjacent to the contact elements 13 and also arranged adjacent to an inner wall of the housing 10. In this embodiment of the invention, the shock hazard protection bodies 102 project, like the shock hazard protection bodies 101, in the insertion direction by a predetermined amount beyond the contact region 130 of the contact elements 13 and are spaced apart from the contact elements 13 at a predetermined distance.

A modification to the above-described embodiment is provided by the shock hazard protection bodies 101 and the further shock hazard protection bodies 102 together with the contact elements 13 which are provided with a plastic tip 131. In this case, the shock hazard protection bodies 102 are arranged, by way of example, only adjacent to the inner wall, which is at the top in the drawing, and to the opposite lateral walls which adjoin said wall, whereas, likewise by way of example, no shock hazard protection bodies 102 are provided adjacent to the lower internal wall.

A pivotable protective flap 15 is provided on the wall bushing 11, by means of which protective flap a pivotable cover for the opening of the housing 10 is likewise provided for shock hazard protection of the contact elements 13. Two locking hooks 151 for releasably fixing the protective flap 15 in its position which covers the opening of the housing 10 are provided on the protective flap 15. For this purpose, latching lugs 115 which correspond to the locking hooks 151 are provided on the wall bushing 11.

The housing 10 is, like the shock hazard protection bodies 101 and 102, composed of a suitable insulating plastic, wherein the shock hazard protection bodies 101 and 102 can be integrally formed with the housing 10. Here, the shock hazard protection bodies 102 can furthermore be spaced apart from their adjacent wall of the housing 10 or be designed as steps of the wall. The shock hazard protection bodies 101 and 102 are particularly advantageously designed in a manner corresponding to recesses 201 and, respectively, recesses 202 in a socket-side plug connector 2 which interacts with the plug connector 1, so that guidance for the plug connector 2 when it is connected to/disconnected from the plug connector 1, which is mounted in a stationary manner on the wall 3 by way of its wall bushing 11, is provided.

Figure 3A:
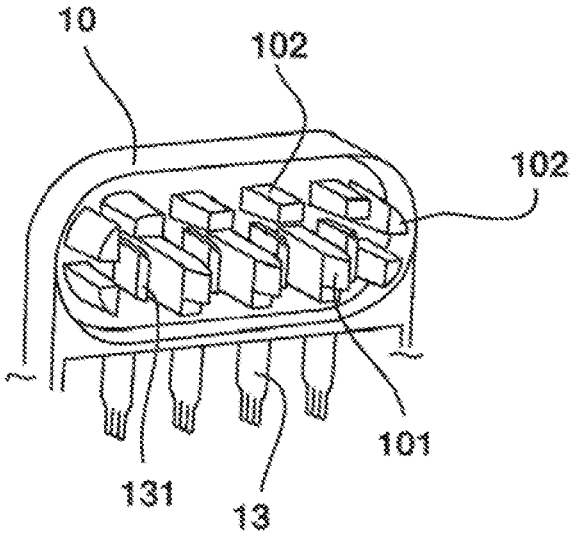
FIG. 3*a* shows a further illustration of the housing of the plug connector of FIG. 1*b;*

A further illustration only of the housing 10, which is fitted with contact elements 13, of the plug connector of FIGS. 1*a* and *b* with the embodiment in which the shock hazard protection bodies 102 are designed in a manner spaced apart from their adjacent internal wall of the housing 10 is shown in FIG. 3*a*.

Figure 2A:
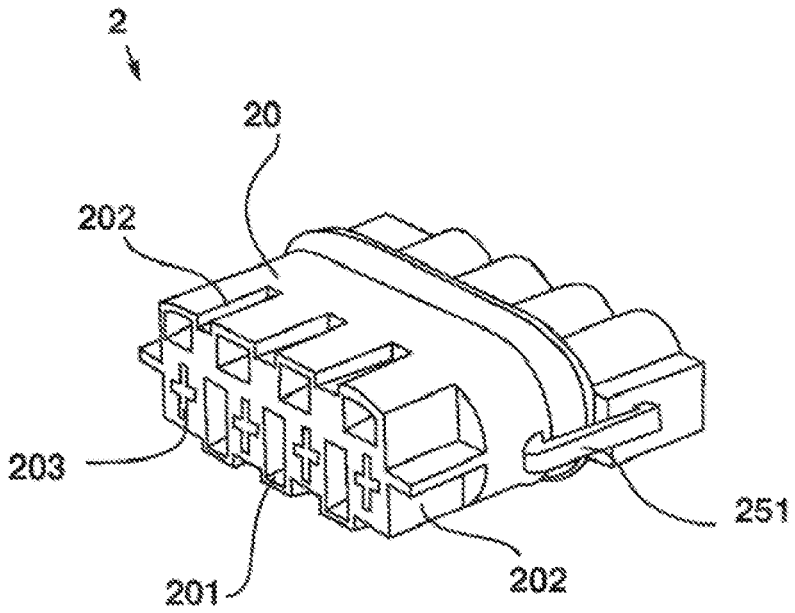
FIG. 2*a* shows a perspective illustration of a plug connector which is suitable for connection to the plug connector of FIGS. 1*a* and *b;*
Figure 2B:
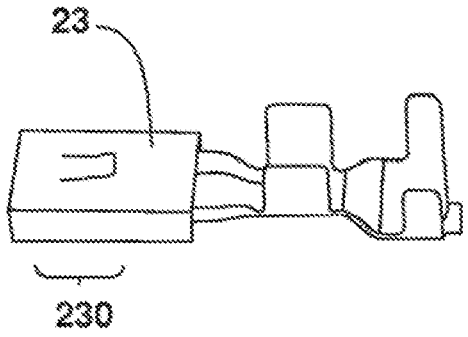
FIG. 2*b* shows a contact element of the plug connector of FIG. 2*a;*

FIG. 2*a* shows a perspective illustration of a plug connector 2 which is suitable for connection to the plug connector 1 of FIGS. 1*a* and *b*, and FIG. 2*b* shows a contact element 23 of the plug connector of FIG. 2*a* in a comparatively enlarged illustration.

The housing 20 of the plug connector 2 is likewise formed from a suitable plastic and in a manner corresponding to the housing 10 of the plug connector 1 of FIGS. 1*a* and *b*. Flat contact elements 23 which are provided with a crimped connection for a cable and are designed as spring contacts are accommodated in in each case one slot from amongst cruciform slots 203 of the housing 20 which are formed in the housing 20. The contact elements 23 have a contact region 230 for their intended contact with the contact region 130 of the flat stamped contact elements 13 of the plug connector 1.

Recesses 201 which extend parallel to the slots 203 into the interior of the housing 20 are formed in the housing 20, which recesses correspond to the shock hazard protection bodies 101 of the plug connector 1 which are described above with reference to FIG. 1*b*. In the event of connection/disconnection of the plug connector 2 to/from the plug connector 1, the shock hazard protection bodies 101 are received by/guided out of the recesses 101, wherein advantageous guidance of the plug connector 2 is provided in each case.

Further recesses 202 are formed at the edge of the housing 2, which further recesses correspond to the shock hazard protection bodies 102 of the plug connector 1 which are described above with reference to FIG. 1*b*. The recesses 202 interact with the shock hazard protection bodies 102 in the same way as the above-described recesses 201 interact with the shock hazard protection bodies 101. In this case, the recesses 102 are designed as steps of the outer wall of the housing 20.

In this case, the shock hazard protection bodies 101 and 102 can be formed in a suitable manner in each case in an interlocking manner with the recesses 201 and 202, wherein a stop for the socket-side plug connector 2 can also be provided on the plug-side plug connector 1 by means of the shock hazard protection bodies 101 and 102 and the recesses 201 and 202.

The further recesses which can be seen in the drawing but are not provided with reference signs can be used for receiving and guiding further shock hazard protection bodies which are formed in a suitable manner in the housing 10 of the plug connector 1 and/or for accommodating signal lines which are respectively not illustrated in the drawings.

In this case, the housing 20 has, by way of its recesses 201 and 202 and its further recesses and by way of its cruciform slots 203, an advantageous structure of honeycomb-like cross section with a correspondingly advantageously low weight and nevertheless desirable stability.

Locking hooks 251 for releasably locking the housing 20 to the housing 10 of the plug connector 1 are also provided on the housing 20, which locking hooks interact with the above-described latching lugs 115. Furthermore, the locking hooks 251 can be designed, as described at the outset, in a manner corresponding to the locking hooks 151 of the cover 15 in such a way that the locking hooks 151 latch with the locking hooks 251 when the plug connectors 1 and 2 are connected to one another. Advantageous releasable secondary locking is provided for the connected plug connectors 1 and 2 in this way.

As likewise mentioned at the outset, the locking hooks 151 can also be designed in a manner corresponding to the housing 20 in such a way that advantageous releasable secondary locking for the connected plug connectors 1 and 2 is provided by means of said locking hooks latching with the housing 20. In this way, desirable reliable operating safety of the plug connectors 1 and 2 for an operator is in particular also provided in the run-up to contact with the contact elements 13 which is to be avoided.

As already mentioned above with reference to FIG. 1*b*, FIG. 3*a* shows a slightly enlarged illustration of the housing 10 of the plug connector 1 of FIG. 1*b* with the contact elements 13 and the shock hazard protection bodies 101 and 102 in an embodiment in which the shock hazard protection bodies 102 are at a distance from their adjacent internal wall of the housing 10. Moreover, it is clear that a suitable encircling seal can be provided on the housing 20.

Figure 3B:
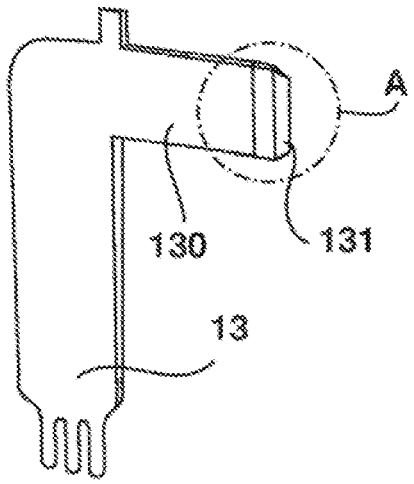
FIG. 3*b* shows an enlarged illustration of a contact element of the plug connector of FIGS. 1*a* and *b;*

FIG. 3*b* shows an enlarged illustration of the flat, stamped contact element 13 of L-shaped design of the plug connector 1 of FIGS. 1*a* and *b* with its contact region 130 which is provided for contact with the contact region 230 of the contact element 23, which is designed as a spring contact, of the plug connector 2. The plastic tip 131 at the end of the contact region 130 is designed so as to taper to a tip in a suitable manner for simple connection of the contact element 13 to the contact element 23. It should be mentioned here that the above-described shock hazard protection bodies 101 and 102 can also be designed so as to taper to a tip in a suitable manner at their end for simple insertion of said shock hazard protection bodies into the recesses 201 and 202.

Figure 3C:
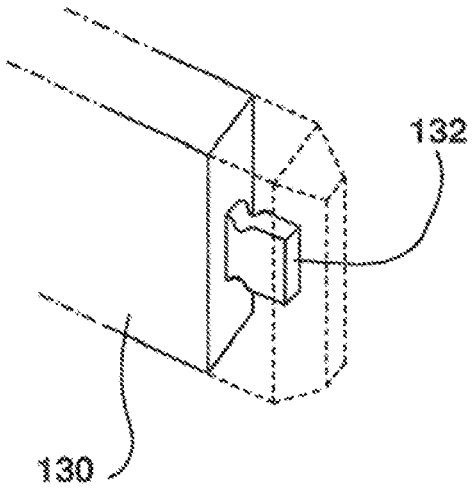
FIG. 3*c* shows an enlarged illustration of the detail A of FIG. 3*b* of the contact element without its plastic tip.

FIG. 3*c* shows an enlarged illustration of the detail A of FIG. 3*b* of the contact element 13 without its plastic tip 131 which is indicated using dashed lines in the drawing, wherein a holding geometry 132 which is suitable for injection molding or latching of the plastic tip 131 is formed at the end of the contact region 130 of the contact element 13, so that the plastic tip is held on the contact element 13 in a stationary and stable manner.

FIG. 4*a* shows the plug connector 1 of FIG. 1*b* on a wall 3 of a housing of an apparatus for its intended use mounted together with a test finger 4, and FIG. 4*b* shows a longitudinal section through the plug connector 1 and the test finger 4 of FIG. 4*a*. As can be seen in FIG. 4*b*, the dome-like protection bodies 101 of the first housing protect adjacent contact elements against contact by a test finger.

The contact elements 13 which are held in the potting compound 14 in the housing 10 extend through a wall of the housing 10, which wall is situated opposite the opening of the housing 10, into the interior of the housing 10 which is freely accessible through its opening. In this way, the contact regions 130 of the contact elements 13 are likewise accessible for connection to corresponding contact elements 23.

The plastic tip 131 is in each case provided at that end of the contact region 130 of the contact elements 13 which faces the opening of the housing. The shock hazard protection bodies 101, which are of integral design with the housing 10 in this embodiment, are arranged adjacent to the contact elements 13 which are arranged parallel in a row.

In this embodiment of the invention, the shock hazard protection bodies 101 project beyond the contact region 130 and also the plastic tip 131 of the contact elements 13 in the insertion direction advantageously by a predetermined amount, whereby only the plastic tip 131 of the contact elements 13 can be contacted by the tip of a standardized test finger 4 in the insertion direction and/or at an angle in relation to the insertion direction. Contact with the contact region 130 of the contact elements 13 by the test finger is not possible, whereby a plug-side plug connector 1 according to an embodiment of the invention which has shock hazard protection and has desirable, reliable operating safety is provided.

Since an abovementioned test finger is suitable for simulating contact by a human finger, a plug-side plug connector 1 according to an embodiment of the invention which has shock hazard protection and has desirable, reliable operating safety is provided.

A plug-side plug connector 1 which is described above with reference to the drawings, in particular together with a corresponding, likewise described socket-side plug connector 2 as mentioned in the introductory part, is suitable in particular for an inverter of a motor vehicle for supplying power to an auxiliary assembly of the motor vehicle.

Even though various aspects or features of the invention are shown respectively in combination in the figures, it is clear to the person skilled in the art—unless stated otherwise—that the illustrated and discussed combinations are not the only ones possible. In particular, mutually corresponding units or feature complexes from different exemplary embodiments can be exchanged with one another.

Plug Connector

LIST OF REFERENCE SIGNS

1 Plug connector, plug-side
10 Housing
101, 102 Shock hazard protection body
11 Wall bushing
115 Latching lug
12 Seal
13 Contact element
130 Contact region
131 Plastic tip
132 Holding geometry
14 Potting compound
15 Cover, protective flap
151 Locking hook
2 Plug connector, socket-side
20 Housing
201, 202 Recess
203 Slot
251 Locking hook
23 Contact element, spring contact
230 Contact region
3 Housing wall
4 Test finger

The invention claimed is:

1. A plug connector assembly comprising a plug-side connector and a socket-side plug connector; wherein the plug-side connector comprises a first housing within which at least two electrical contact elements, each comprising a plastic tip formed at one end of a contact region, are arranged next to one another, in parallel, and extend along an insertion direction within an opening of the first housing;

the first housing further comprises a pivotable protective flap, including at least one protective flap locking hook, which covers the opening of the first housing; and at least one dome-like shock hazard protection body within the first housing, extends adjacent the contact elements in the insertion direction; and at least one latching lug is provided on either the first housing or a wall bushing for the first housing; and the socket-side plug connector comprises a second housing that includes at least one socket locking hook; such that, when the protective flap covers the opening of the first housing, the protective flap locking hook releasably engages with the latching lug; and when the protective flap is pivoted to reveal the opening of the first housing, the socket locking hook, of the socket-side plug connector, releasably engages the latching lug upon mating with the plug-side connector along the insertion direction.

2. The plug connector assembly as claimed in claim 1, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug-side plug connector is provided.

3. The plug connector assembly as claimed in claim 1, having a plurality of contact elements which are arranged parallel next to one another successively in a row and having a plurality of shock hazard protection bodies.

4. The plug connector assembly as claimed in claim 1, wherein a plastic tip is provided on a stump-like holding geometry of the contact elements which is formed in each case at an end of the contact region, wherein the plastic tip can be injection-molded onto the holding geometry.

5. The plug connector assembly as claimed in claim 1, wherein the dome-like shock hazard protection body and/or the further shock hazard protection body are/is integrally formed with the housing.

6. The plug connector assembly as claimed in claim 1, wherein the first plug-side plug connector is provided on a wall of an inverter of a motor vehicle for supplying power to an auxiliary assembly of the motor vehicle, and the dome-like protection bodies of the first plug-side plug protect adjacent contact elements against contact by a test finger.

7. The plug connector assembly as claimed in claim 1, wherein the dome-like shock hazard protection body is designed in a manner corresponding to a recess of a housing of the socket-side plug connector in such a way that guidance for connecting and/or disconnecting the plug-side plug connector and the socket-side plug connector is provided by the dome-like shock hazard protection body in interaction with the recess.

8. The plug connector assembly as claimed in claim 7, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug-side plug connector is provided.

9. The plug connector assembly as claimed in claim 1, wherein the at least one dome-like shock hazard protection body projects beyond at least the contact region of the contact elements by a predetermined amount.

10. The plug connector assembly as claimed in claim 9, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug-side plug connector is provided.

11. The plug connector assembly as claimed in claim 9, wherein at least one further shock hazard protection body is provided in the housing, wherein the height of the at least one further shock hazard protection body corresponds at least approximately to the height of the contact region of the contact elements.

12. The plug connector assembly as claimed in claim 11, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug connector is provided.

13. The plug connector assembly as claimed in claim 11, wherein the further shock hazard protection body projects beyond at least the contact region of the contact elements by a second predetermined amount.

14. The plug connector assembly as claimed in claim 13, wherein the dome-like shock hazard protection body is provided between two adjacent contact elements, wherein the dome-like shock hazard protection body corresponds to a first recess of the housing of the socket-side plug connector, and/or the further shock hazard protection body is provided adjacent to an inner wall of the housing, wherein the further shock hazard protection body corresponds to a second recess of the housing of the socked-side plug connector, so that guidance for connecting and/or disconnecting the plug-side plug connector and the socket-side plug connector is provided by the dome-like shock hazard protection body and/or the further shock hazard protection body in each case in interaction with the first recess and/or the second recess.

15. The plug connector assembly as claimed in claim 13, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug connector is provided.

16. The plug connector assembly as claimed in claim 11, wherein the dome-like shock hazard protection body is provided between two adjacent contact elements, wherein the dome-like shock hazard protection body corresponds to a first recess of the housing of the socket-side plug connector, and/or the further shock hazard protection body is provided adjacent to an inner wall of the housing, wherein the further shock hazard protection body corresponds to a second recess of the housing of the socket-side plug connector, so that guidance for connecting and/or disconnecting the plug-side plug connector and the socket-side plug connector is provided by the dome-like shock hazard protection body and/or the further shock hazard protection body in each case in interaction with the first recess and/or the second recess.

17. The plug connector assembly as claimed in claim 16, wherein at least one locking hook is provided on the socket-side plug connector, which locking hook corresponds to at least one latching lug which is provided on the housing or on a wall bushing for the housing in such a way that releasable locking of the socket-side plug connector which is connected to the plug-side plug connector is provided.

* * * * *